US007499061B2

(12) United States Patent
Hiraki et al.

(10) Patent No.: US 7,499,061 B2
(45) Date of Patent: Mar. 3, 2009

(54) IMAGE SIGNAL PROCESSING DEVICE

(75) Inventors: Katsuyoshi Hiraki, Kawasaki (JP); Kazuhiro Nukiyama, Kawasaki (JP); Hiroshi Yamazaki, Kawasaki (JP); Toshiaki Suzuki, Kawasaki (JP)

(73) Assignee: Sharp Kabushiki Kaisha, Osaka (JP)

( * ) Notice: Subject to any disclaimer, the term of this patent is extended or adjusted under 35 U.S.C. 154(b) by 345 days.

(21) Appl. No.: 11/103,098

(22) Filed: Apr. 11, 2005

(65) Prior Publication Data

US 2006/0012606 A1 Jan. 19, 2006

(30) Foreign Application Priority Data

Jul. 13, 2004 (JP) ..... 2004-205745

(51) Int. Cl.
*G09G 5/00* (2006.01)

(52) U.S. Cl. ..... 345/648; 345/698

(58) Field of Classification Search ..... 345/590, 345/698, 695, 204
See application file for complete search history.

(56) References Cited

U.S. PATENT DOCUMENTS 6,819,333 B1 * 11/2004 Sadowski ..... 345/647
7,006,688 B2 * 2/2006 Zaklika et al. ..... 382/165
7,081,899 B2 * 7/2006 Shimazaki et al. ..... 345/590
7,221,791 B2 5/2007 Kagawa et al.

FOREIGN PATENT DOCUMENTS

| | | |
|---|---|---|
| CN | 1479994 A | 3/2004 |
| JP | 5197357 | 8/1993 |
| JP | 6217242 | 8/1994 |

* cited by examiner

*Primary Examiner*—M Good Johnson
(74) *Attorney, Agent, or Firm*—Greer, Burns & Crain, Ltd.

(57) ABSTRACT

An image signal processing device is provided, which has therein a memory to store a first correction parameter to convert a specific region of display image of a display panel, a first coefficient generating section to generate a first coefficient for each pixel in a display panel based on the first correction parameter, a first correction value generating section to generate a first correction value for each pixel based on an input image signal, a first multiplier to multiply the first coefficient by the first correction value for each pixel and output a first multiplied value, and a first adder to add or subtract for each pixel the first multiplied value to or from the input image signal.

16 Claims, 14 Drawing Sheets

IMAGE SIGNAL PROCESSING DEVICE

CROSS-REFERENCE TO RELATED APPLICATIONS

This application is based upon and claims the benefit of priority from the prior Japanese Patent Application No. 2004-205745, filed on Jul. 13, 2004, the entire contents of which are incorporated herein by reference.

BACKGROUND OF THE INVENTION

1. Field of the Invention

This invention relates to an image signal process.

2. Description of the Related Art

In recent years, demands for energy saving and space saving result in the widespread use of liquid crystal displays including monitors for notebook PCs (personal computers), monitors for desktop PCs, liquid crystal televisions and so forth.

Under such circumstances, further cost reduction of the liquid crystal displays improving display quality is demanded. To attain the goal, cost reduction is pursued in terms of material property, display element configuration, drive system, and fabrication technique of the liquid crystal.

The following Patent Documents 1 and 2 disclose liquid crystal displays to prevent color heterogeneity of a display image.

[Patent Document 1] Japanese Patent Application Laid-open No. 5-197357

[Patent Document 2] Japanese Patent Application Laid-open No. 6-217242

As a method to alleviate irregular display is there a method to perform signal processing to a defective portion. However, it is insufficient in applying to an actual product in terms of the implementation cost and practicability.

SUMMARY OF THE INVENTION

It is an object of the present invention to provide an image signal processing device and a method thereof to easily alleviate the irregular display of a display panel.

According to one aspect of the present invention, an image signal processing device is provided which includes: a memory to store a first correction parameter for converting a specific region of display image of a display panel; a first coefficient generating section to generate a first coefficient for each pixel of the display panel based on the first correction parameter; a first correction value generating section to generate a first correction value for each pixel based on input image signal, a first multiplier to output a first multiplied value by multiplying the first coefficient and the first correction value for each pixel; and an adder to add or subtract the first multiplied value to or from the input image signal value for each pixel.

DETAILED DESCRIPTION OF THE PREFERRED EMBODIMENTS

First Embodiment

Figure 2:
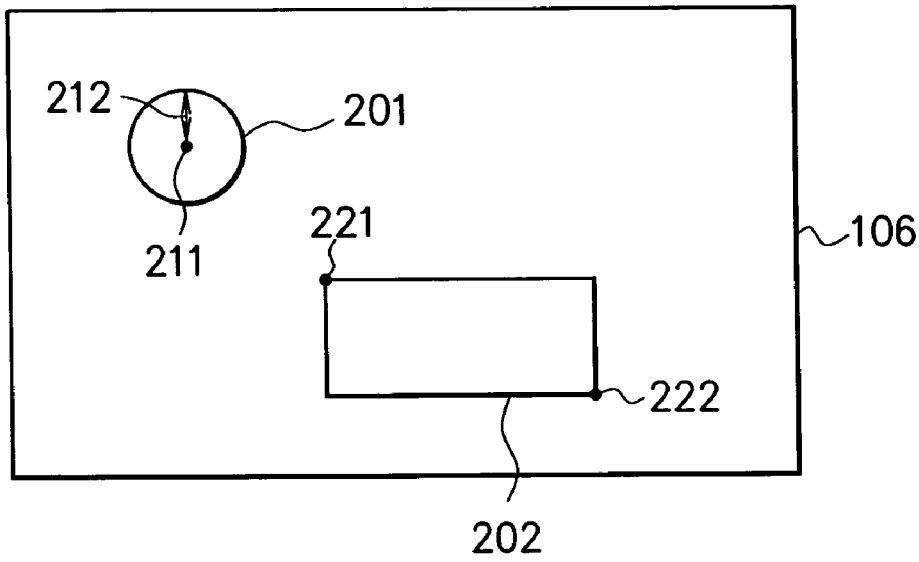
FIG. 2 is a surface view of a liquid crystal display panel.
Figure 3:
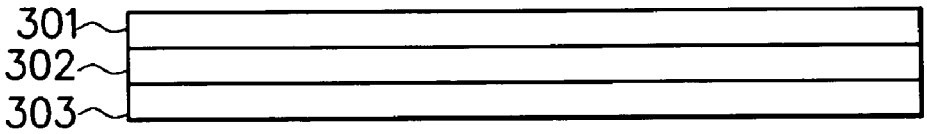
FIG. 3 is a sectional view of the liquid crystal display panel.

FIG. 2 is a surface view of a liquid crystal panel 106, and FIG. 3 is a sectional view of the liquid crystal panel 106. In the liquid crystal panel 106, a liquid crystal layer 302 is infilled between two sheets of glasses 301 and 303. The thickness of the liquid crystal layer 302 is not uniform due to variations caused through the fabrication process and pressure imposed externally. Normally, the liquid crystal layer 302 having the thinner thickness is darker, and the one having the thicker thickness is brighter. Consequently, if the liquid crystal layer 302 has a nonuniform thickness, irregular displays 201, 202, and so forth are caused. It should be noted that the irregular displays 201, 202, and so forth occur in each liquid crystal display panel 106 due to other reasons as well. The irregular display 201 is circular, presented with a center point 211 and a half diameter 212. The irregular display 202 is rectangular, presented with a top left point 221 and a top right point 222 forming a diagonal of the rectangle.

Figure 4:
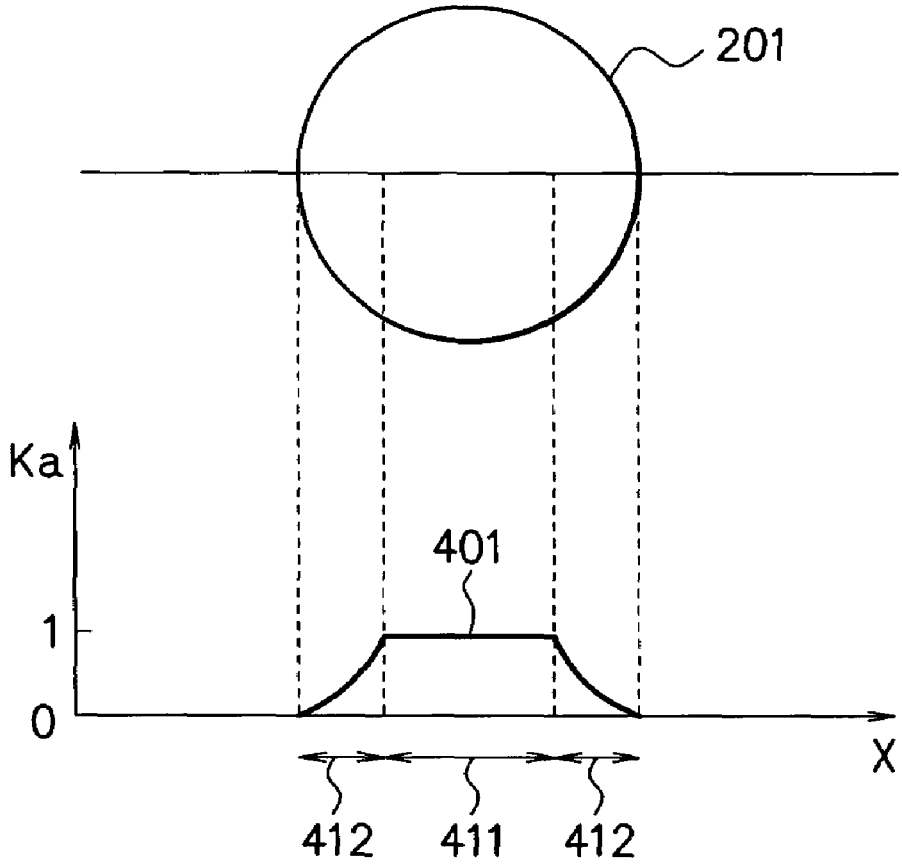
FIG. 4 is an explanatory diagram of a correction coefficient for correcting irregular display.

FIG. 4 is an explanatory diagram of a correction coefficient 401 to thereby correct the irregular display 201. The horizontal axis indicates the x coordinate of the irregular display 201, while the vertical axis indicates a correction coefficient Ka.

The irregular display 201 has therein a center portion 411 and a boundary portion 412. The correction coefficient Ka for the center portion 411 is one. The correction coefficient Ka for the boundary portion 412 is a decimal which is less than one and more than 0 (zero). The correction value of the irregular display 201 is calculated by multiplying a predetermined correction value by the correction coefficient Ka. A correction process is performed by adding the correction value to an input image signal. The correction coefficient Ka for an outer region of the irregular display 201 is 0 (zero), so that its correction value is 0 (zero). The correction coefficient Ka for the center portion 411 is 1, so that the correction value is as predetermined. In the boundary portion 412, the correction coefficient Ka is varying such that the tone is gradated across the outer region of the irregular display 201 and the center portion 411. In the following, the correction method is explained in detail.

Figure 1:
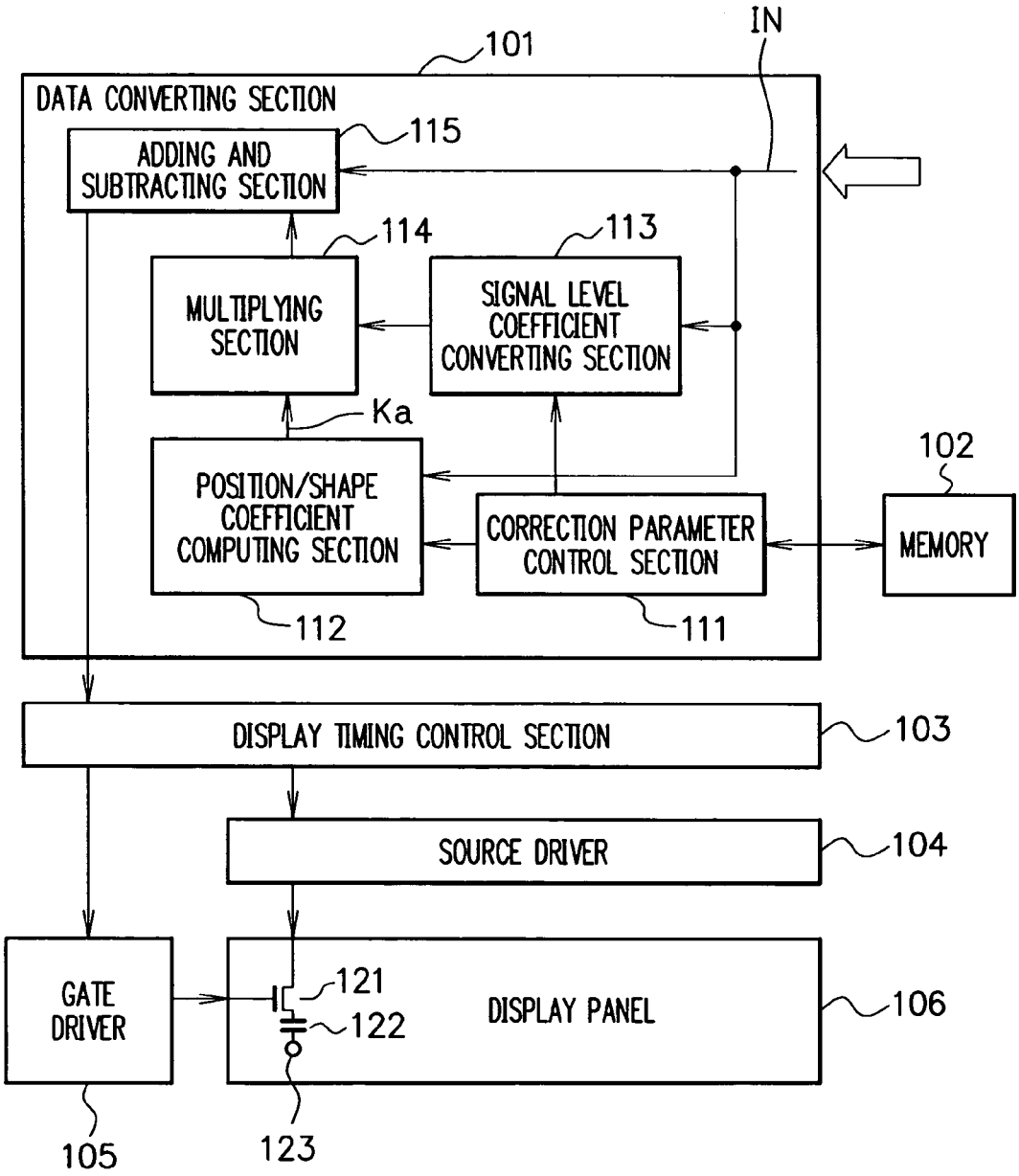
FIG. 1 is a block diagram showing a configuration example of a liquid crystal display (image signal processing device) according to a first embodiment of the present invention.

FIG. 1 is a block diagram showing a configuration example of a liquid crystal display (image signal processing device) according to a first embodiment of the present invention. A data converting section 101 and a display timing control section 103 include ASICs (application specific integrated circuits).

A nonvolatile memory 102 stores a correction parameter to thereby correct a local irregular display of a pixel in the display panel 106. The correction parameter contains a shape data and correction level of the irregular display. As shown in FIG. 2 for example, the circular shape data of the irregular display 201 is presented with the center point 211 and the half diameter 212, while the rectangular shape data of the irregular display 202 is presented with the top left point 211 and the top right point 222 forming a diagonal of the rectangle.

The correction parameter control section 111 reads a correction parameter out of the memory 102, outputs the shape data to a position shape coefficient computing section 112, and outputs the correction level to a signal level coefficient converting section 113.

The position shape coefficient computing section 112 inputs therein the pixel position data of an input image signal IN (horizontal synchronous signal and vertical synchronous signal, and so forth), and generates the correction coefficient Ka for each pixel of the display panel 106, based on the correction parameter. The correction parameter Ka is, as shown in FIG. 4, determined according to the pixel position data (X coordinate and Y coordinate). The center portion 411 has a correction coefficient Ka of 1. The boundary portion 412 has correction coefficients Ka of a decimal less than 1 and more than 0 (zero). The outer region of the irregular display 201 has a correction coefficient Ka of 0 (zero). Note that the input image signal IN contains the pixel position data and pixel data. The pixel data is serially inputted in the order of scanning.

The signal level coefficient converting section 113 has therein a look-up table (LUT) or a computation circuit, and generates the correction value for each pixel based on the input image signal IN and correction level. In order to correct the irregular display, the tone value of the pixel data is transformed. For example, a pixel data has a tone value of 0 (zero) to 255. Here, a tone value of, for instance, 100 of an input pixel data may be transformed into 90 so that the irregular display can be corrected. Since this transformation of the tone value results in a narrower range thereof, a transformation into a dismal value such as 89.5 is allowed. The gradation value of 89.5 can be realized in such a manner that the gradation values of 89 and 90 are alternately presented in frame. Further, in the tone value transformation, a constant correction amount is not necessary given to all tone levels, but instead it is preferred that the correction amount is transformed depending on the tone value. For example, when the tone value is to be converted from 100 to 90, a signal level coefficient converting section 113 outputs a correction value of −10 to a multiplying section 114.

The multiplying section 114 multiplies the correction coefficient Ka by the correction value for each pixel, and outputs the multiplied value to an adding and subtracting section 115. In FIG. 4, the center portion 411 has a correction coefficient Ka of 1, so that the multiplied value equals to the correction value. The boundary portion 412 has correction coefficients Ka of a decimal less than 1 and more than 0 (zero), so that the multiplied value is smaller than the correction value. The outer region of the irregular display 201 has a correction coefficient Ka of 0 (zero), so that the multiplied value is 0 (zero).

The adding and subtracting section 115 adds or subtracts the multiplied value to or from the input image signal IN for each pixel, and outputs a correction image signal to the display timing control section 103. For example, when the tone value of the input image signal IN is 100 and the multiplied value is −10, the adding and subtracting section 115 outputs a correction image signal of a 90 tone value.

The timing control section 103 inputs therein the correction image signal, controls the timing of a source driver 104 and a gate driver 105, and at the same time outputs the correction image signal (pixel data) to the source driver 104.

The liquid crystal display panel 106 is the same as the display panel 106 of FIG. 2 and FIG. 3, and has a plurality of thin-film transistors (TFTs) 121, each corresponding to each of plural pixels in two-dimensional array. The transistor 121 has its gate connected to the gate driver 105, its source connected to the source driver 104, and its drain connected to a common electrode 123 through a liquid crystal layer (capacity) 122.

The gate driver 105 outputs to the transistors 121 gate pulses for sequentially scanning and selecting transistors 121 in two-dimensional array. The source driver 104 outputs a liquid crystal driving voltage based on the correction image signal. The transistor 121 is turned on when the gate pulse is supplied, and the crystal driving voltage is supplied from the source driver 104 to the liquid crystal layer 121. The liquid crystal layer 122 has its transmittance changed depending on the liquid crystal driving voltage, resulting in a change in its level of brightness.

As described above, the position shape coefficient computing section 112 calculates the correction coefficient for the irregular display at physical coordinates of the display panel 106, while at the same time the signal level coefficient converting section 113 computes the irregular display correction value for the input tone value IN. The computed results are multiplied in the multiplying section 114 so that the correction level is calculated. The adding and subtracting section 115 adds or subtracts the multiplied result in the multiplying section 114 to or from the input image signal IN, so that a correction image signal can be obtained which is optimal for displaying with less difference from the remaining portion that is normal. Outputting this correction image signal to the controlling portion 103 permits the display panel 106 to display pixel data corrected in terms of the irregular display, such that the irregularity is not distinct.

It should be noted that the signal level coefficient converting section 113 may generate the correction value according to the input image signal IN, irrespective of the correction parameter.

Second Embodiment

Figure 5:
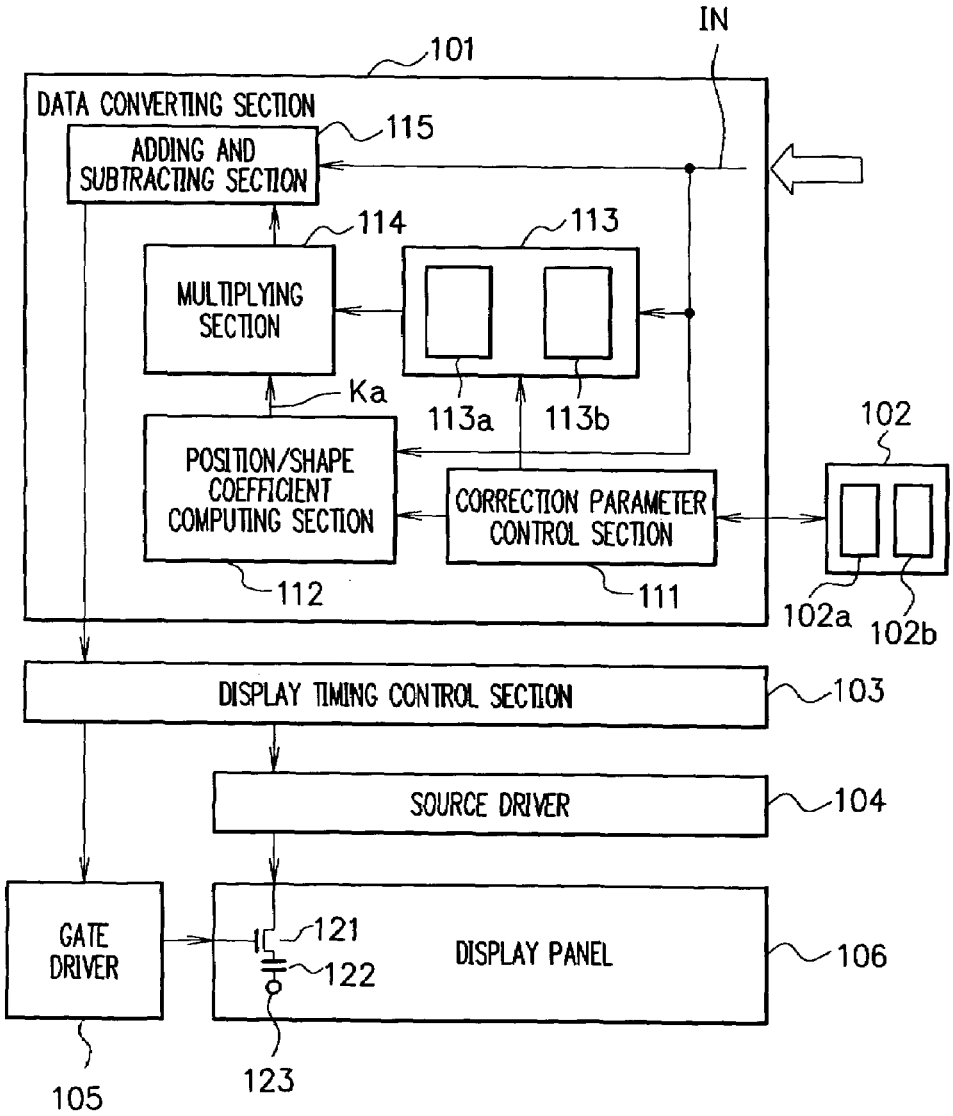
FIG. 5 is a block diagram showing a configuration example of a liquid crystal display according to a second embodiment of the present invention.

FIG. 5 is a block diagram showing a configuration example of a liquid crystal display according to a second embodiment of the present invention. Explained herein are points of difference of the second embodiment from the first embodiment (FIG. 1). The memory 102 stores a correction parameter 102*a* to thereby correct irregular display in a region 201 in FIG. 2, and a correction parameter 102*b* to thereby correct an irregular display in a region 202 in FIG. 2. The correction parameters 102*a* and 102*b* respectively contain correction levels different from each other and suitable for the respective irregular displays.

The correction parameter control section 111 outputs the correction level of the correction parameter 102*a* and the correction level of the correction parameter 102*b* to the signal level coefficient converting section 113. The signal level coefficient converting section 113 has therein a converting section 113*a* to generate a correction value according to the correction level of the correction parameter 102*a*, and a converting section 113*b* to generate a correction value according to the correction level of the correction parameter 102*b*. The converting section 113 generates each different correction value for the regions 201 and 202 depending on the correction parameters 102*a* and 102*b*. Note that the converting sections 113*a* and 113*b* may be configured as one converting section.

As has been described, the correction parameter control section 111 is characterized in that it reads out plural correction parameters 102*a* and 102*b* from the memory 102 and tentatively stores them, and switches the correction parameter to be supplied to the position shape coefficient computing section 112 and the signal level coefficient converting section 113. The switching can be realized either by calculating in the correction parameter control section 111 or by readily embedding the switching data in the correction parameter. The correction parameter control section 111 switches to one of two correction levels according to the switching data, and supplies it to the signal level coefficient converting section 113. Note that it may be the signal level coefficient converting section 113 which selects one of two correction levels according to the switching data.

Third Embodiment

Figure 6:
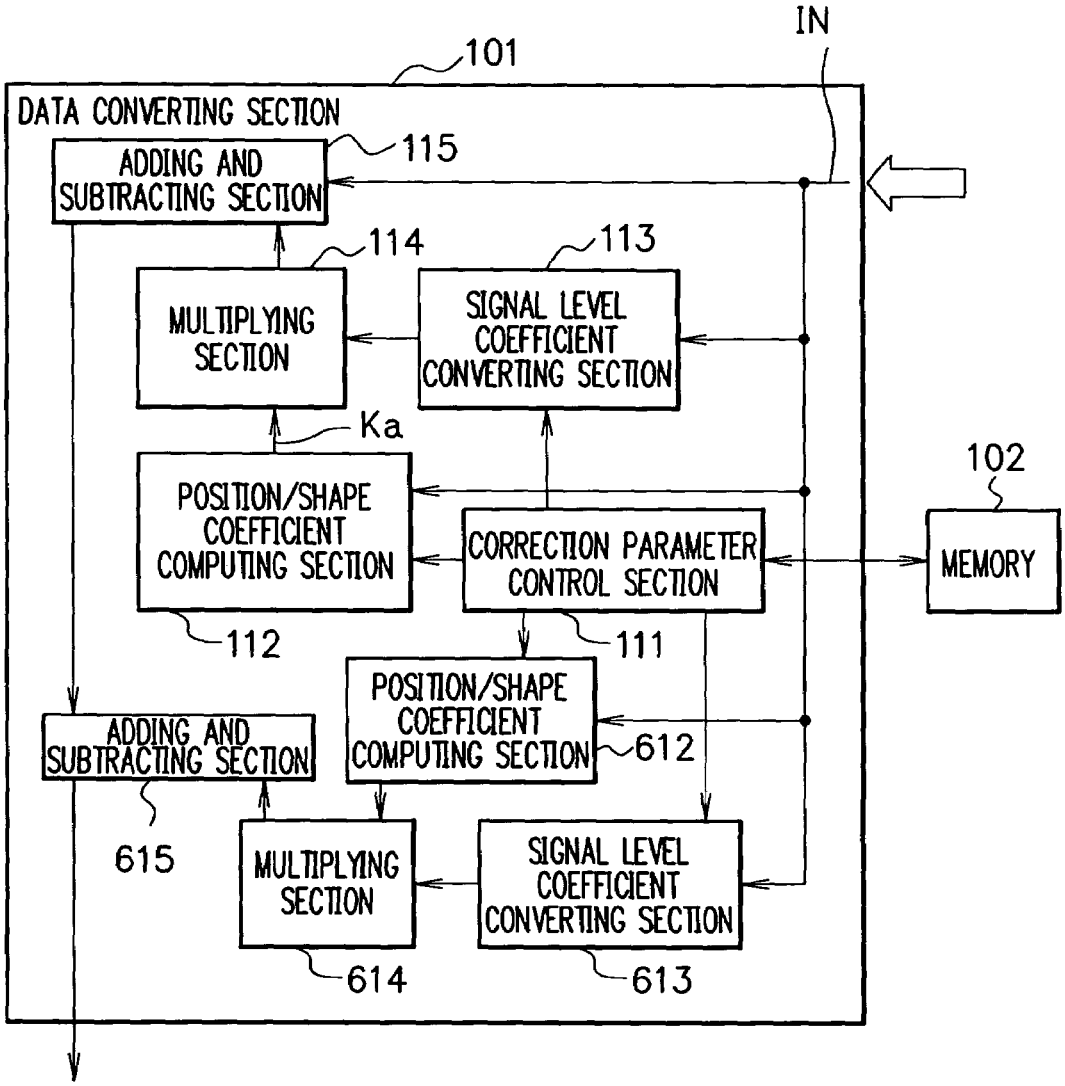
FIG. 6 is a block diagram showing a configuration example of a liquid crystal display according to a third embodiment of the present invention.

FIG. 6 is a block diagram showing a configuration example of a liquid crystal display according to a third embodiment of the present invention. Explained herein will be points of difference of the third embodiment from the first embodiment (FIG. 1). A position shape coefficient computing section 612, a signal level coefficient converting section 613, a multiplying section 614, and an adding and subtracting section 615 are respectively added corresponding respectively to the above-described position shape coefficient computing section 112, signal level coefficient converting section 113, multiplying section 114, and adding and subtracting section 115.

The correction parameter control section 111 reads out the correction parameter from a memory 102, and outputs it to the position shape coefficient computing section 612. The position shape coefficient computing section 612 outputs to the multiplying section 614 a correction coefficient for each pixel in a display panel 106 based on the correction parameter. The signal level coefficient converting section 613 outputs to the multiplying section 614 a correction value for each pixel based on an input image signal IN and correction parameter. The multiplying section 614 multiplies the correction coefficient and correction value for each pixel and outputs the multiplied value to the adding and subtracting section 615. The adding and subtracting section 615 adds or subtracts the multiplied value of the multiplying section 614 to or from the output value from the adding and subtracting section 115 for each pixel, and outputs a correction image signal to a control section 103.

Figure 7:
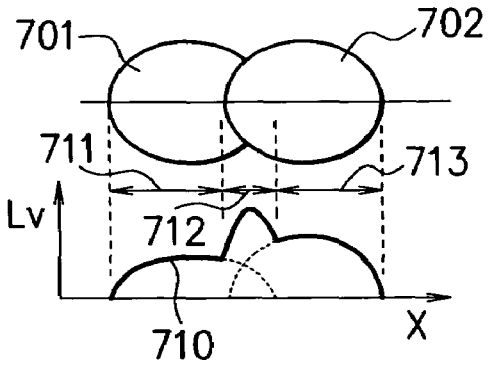
FIG. 7 is an explanatory diagram of correction levels of two correction regions.

FIG. 7 is an explanatory diagram of a correction level 710 for two correction regions 701 and 702. The correction level 710 is presented by the horizontal axis showing the x coordinate of the correction regions 701 and 702, and the vertical axis showing the correction level.

The memory 102 in FIG. 6 stores two correction parameters for correcting irregular display of the correction regions 701 and 702. For example, the correction region 701 is corrected by the position shape coefficient computing section 112, signal level coefficient converting section 113, multiplying section 114, and adding and subtracting section 115. The correction region 702 is corrected by the position shape coefficient computing section 612, signal level coefficient converting section 613, multiplying section 614, and adding and subtracting section 615.

A region 711 is a correction region solely for the correction region 701. A region 713 is a correction region solely for the correction region 702. A region 712 is a region where both the correction regions 701 and 702 are synthesized and corrected. The configuration illustrated in FIG. 6 permits synthetic correction of the two correction regions 701 and 702.

As mentioned above, the present embodiment is characterized in that the two correction computation circuits, respectively composed of the position shape coefficient computing section, signal level coefficient converting section, multiplying section, and adding and subtracting section, are connected in series and supplies separate parameters as correction parameter. This allows correction of a complicated shape as illustrated in FIG. 7.

Fourth Embodiment

A fourth embodiment of the present invention has a basic configuration identical to the first embodiment (FIG. 1).

Figure 8:
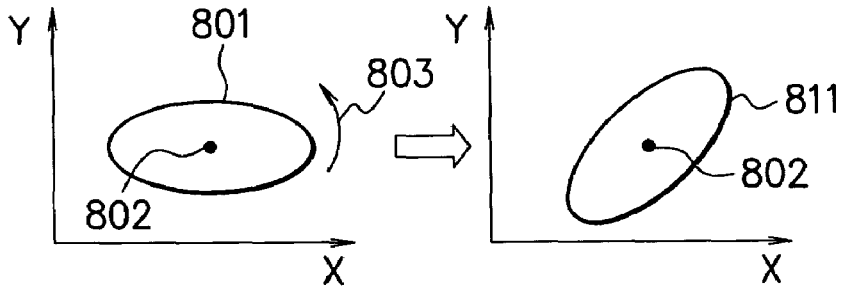
FIG. 8 is a diagram showing an example of a shape of the correction region being rotated.

As shown in FIG. 8, the memory 102 stores as the correction parameter a shape data and rotation data 803 of an oval 801 having a center point 802. The rotation data includes rotating direction and rotating angle. After the correction parameter control section 111 reads out the correction parameter, the oval 801 is rotated according to the rotation data 803. This results in generation of an oval 811 having a center point 802. With the oval 811 as the correction region, the position shape coefficient computing section 112 generates a correction coefficient, and the signal level coefficient converting 113 generates a correction value.

Figure 9:
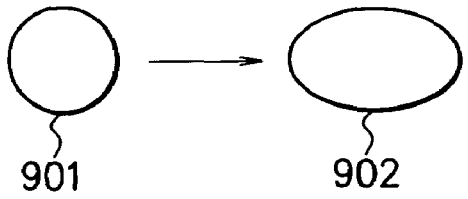
FIG. 9 is a diagram showing an example of the shape of the correction region being deformed.

Further, the memory 102 stores as the correction parameter a circle shape data 901 and distortion data as shown in FIG. 9. The correction parameter control section 111 reads out the correction parameter and distorts the circle 901 according to the distortion data. This results in generation of an oval 902. With the oval 902 as the correction region, the position shape coefficient computing section 112 generates a correction coefficient, and the signal level coefficient converting section 113 generates a corrected value.

As described above, the memory 102 stores correction parameters including the shape data and shape transforming data (rotation data or distortion data, and so forth) of an irregular display. The position shape coefficient computing section 112 rotates or distorts the shape based on the shape data and shape transforming data, and generates a correction coefficient according to the rotated or distorted shape. The signal level coefficient converting section 113 rotates or distorts the shape based on the shape data and shape transforming data, and generates a correction value according to the rotated or distorted shape. The rotation or distortion of the shape may be performed by the correction parameter control section 111.

It should be noted that the coordinate conversion may be performed for the shape data before generating the correction coefficient and correction value, or the coordinate conversion may be performed for the correction coefficient and correction value without converting the coordinates of the shape data. Further, the signal level coefficient converting section 113 may generate the correction value according to the input image signal IN irrespective to the correction parameter.

Fifth Embodiment

A fifth embodiment of the present invention has a basic configuration identical to the first embodiment (FIG. 1).

Figure 10:
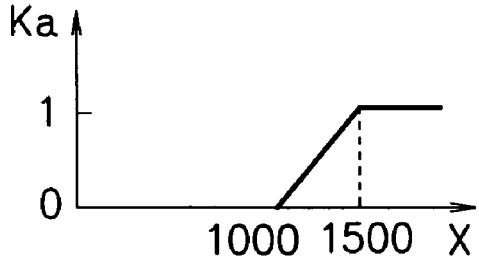
FIG. 10 is an explanatory diagram showing a method for a position shape coefficient computing section to compute a correction coefficient using coordinate data.

FIG. 10 is an explanatory diagram of a method for the position shape coefficient computing section 112 to thereby compute correction coefficient using a coordinate data. The horizontal axis indicates the x coordinate, while the vertical axis indicates the correction coefficient Ka. The gradating region in the x coordinate is from 1000 to 1050 corresponding to the boundary portion 412 in FIG. 4. The x coordinate data from 1000 to 1050 is presented in 11 bits. Computing the correction coefficient of the gradating region using this 11-bit x coordinate data results in a large-size circuit due to the large number of bits. Accordingly, the x coordinate data is divided into an upper data and lower data, in which 1000 of the upper data is omitted. That is to say, the correction coefficient Ka is computed using the 6-bit x coordinate data from 0 to 50 as the lower data. The 6-bit computation permits a simple calculation and a smaller-size circuit. The correction coefficient Ka of the lower data of the x coordinate data shall then be applied in a relative position to the upper data of the x coordinate data.

Figure 11:
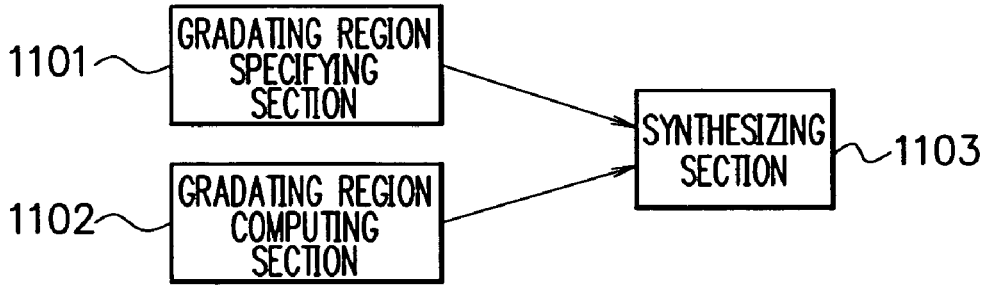
FIG. 11 is a diagram showing an example of a circuit configuration of the position shape coefficient computing section to apply the computation illustrated in FIG. 10.

FIG. 11 is a diagram showing a circuit configuration example of the position shape coefficient computing section 112 for applying the above computing method. A gradating region computing section 1102 computes the correction coefficient Ka using the 6-bit x coordinate lower data. A gradating region specifying section 1101 specifies a position of the gradating region based on the x coordinate upper data (for example 1000). A synthesizing section 1103 synthesizes the correction coefficient Ka computed by the gradating region computing section 1102 and the x coordinate position specified by the gradating region specifying section 1101, and applies the correction coefficient.

As described above, the position shape coefficient computing section 112 generates the correction coefficient Ka by performing computation by reducing the number of bits indicating the pixel position, and thereafter compensating the pixel position of the reduced number of bits. In computing in the position shape coefficient computing section 112, the coordinate data can be divided into the upper data and lower data where the upper data is trimmed in computation of a part which may result in a large-size circuit, such that the circuit size can be reduced. When the computation accuracy deteriorates, a linear computation may be performed in the lower bit, or a LUT may be used for amendment.

Sixth Embodiment

A sixth embodiment of the present invention has a basic configuration identical to the first embodiment (FIG. 1).

Figure 12A:
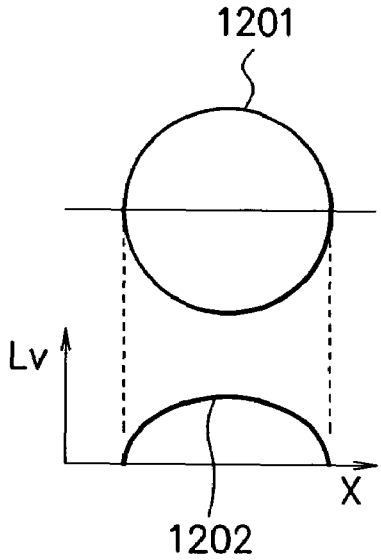
FIG. 12A is a diagram showing a correction level to correct a circle-shaped correction region.

FIG. 12A is a diagram showing a correction level 1202 for correcting a circle-shaped correction region 1201. The correction level 1202 is presented by the horizontal axis indicating the x coordinate, and the vertical axis indicating the correction level. Such correction so as to reduce irregular display may cause noise when the boundary of a correction region 1201 is emphasized.

Figure 12B:
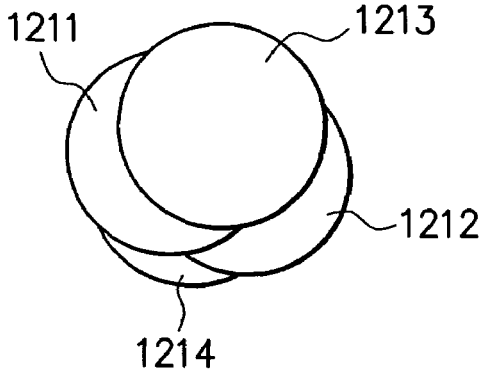
FIG. 12B is a diagram showing an example to shift the correction region in frame.

As shown in FIG. 12B, the above-mentioned correction region 1201 is shifted in frame. In a first frame, a correction region 1211 is corrected. In a second frame, a correction region 1212 is corrected. In a third frame, a correction region 1213 is corrected. In a fourth frame, a correction region 1214 is corrected. The correction region shifting in frame allows the contour portion (boundary portion) of the correction region to temporally disperse, and thereby prevents noise.

The position shape coefficient computing section 112 generates the correction coefficient Ka such that the irregular display region to be corrected is shifted at each predetermined time. That is to say, in computing by the position shape coefficient computing section 112, the specified coordinate data of the irregular display is slimly shifted in frame (field), so that the region to be corrected shifts temporally. This results in temporal disperse of the boundary portion of the correction region, and a less distinct boundary.

Seventh Embodiment

Figure 13:
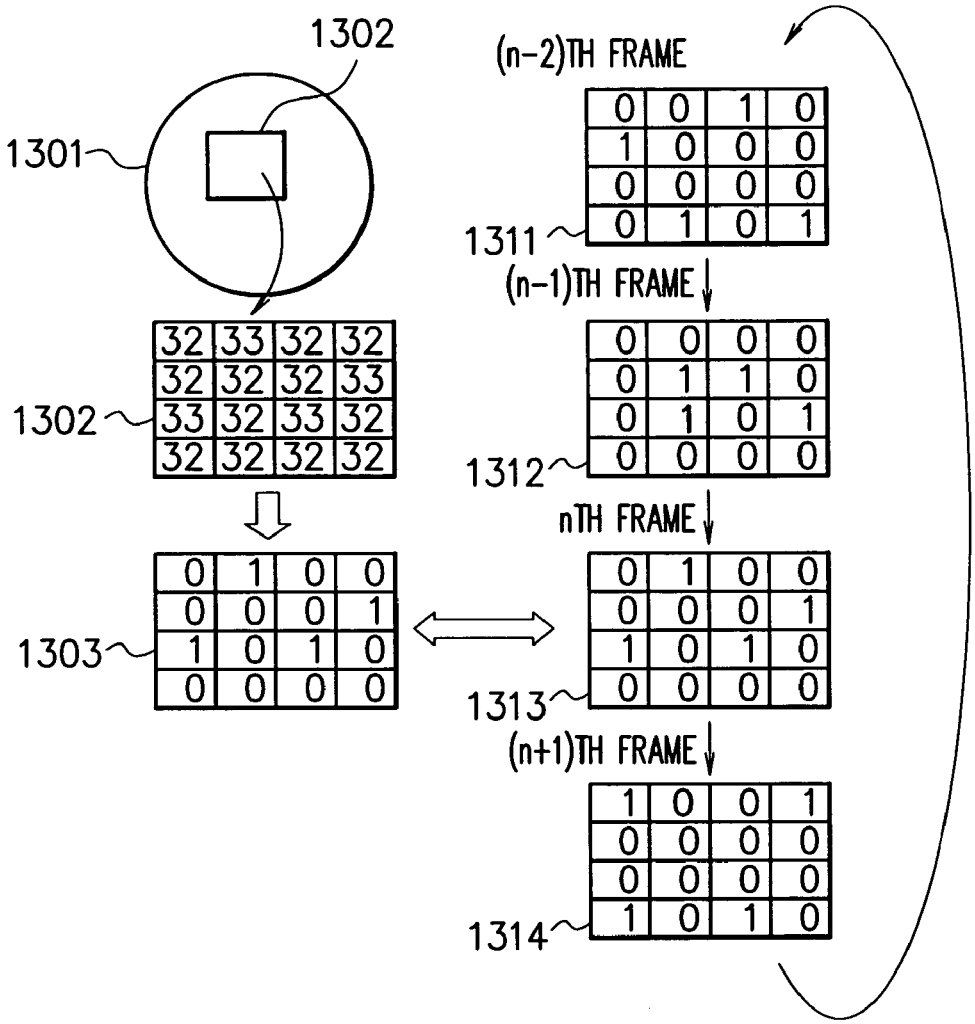
FIG. 13 is an explanatory diagram of a dithering process according to a seventh embodiment of the present invention.

FIG. 13 is an explanatory diagram of a dithering process according to a seventh embodiment of the present invention. The method to present the tone value of 89.5 is described above, in which the tone values of 89 and 90 are alternately presented in frame. On the other hand, the dithering realizes a tone value of, for example, 0.25, in such a manner that four mask patterns 1311 to 1314 are repeatedly presented in frame. Each of the mask patterns 1311 to 1314 has, for example, a pattern of 4×4 pixels. A (n−2) th frame presents the mask pattern 1311. A (n−1) th frame presents the mask pattern 1312. A nth frame presents the mask pattern 1313. A (n+1) th frame presents the mask pattern 1314. Thereafter, the process is repeated by returning to the mask pattern 1311. Such dithering process is performed in correcting irregular display.

Next, the case of inputting an input image signal IN which has been dithered externally will be explained. In the input image signal IN, a part of an irregular display 1301 which is a 4×4 pixel region 1302 is extracted. In the region 1302, a difference data 1303 is calculated with a minimum value (for example 32) as a criterion. The difference data 1303 has a relative value pattern of the data of the region 1302.

The difference data 1303 is then compared with the mask patterns 1311 to 1314. When the mask pattern 1313 which coincides with the difference data 1303 exists, the input image pattern 1303 and the dithering pattern 1313 interfere, causing a pattern emphasis and consequential noise. Here, in the dithering process, the mask pattern 1313 is skipped, and the three mask patterns 1311, 1312, and 1314 are repeatedly presented, such that the noise is prevented.

Figure 14:
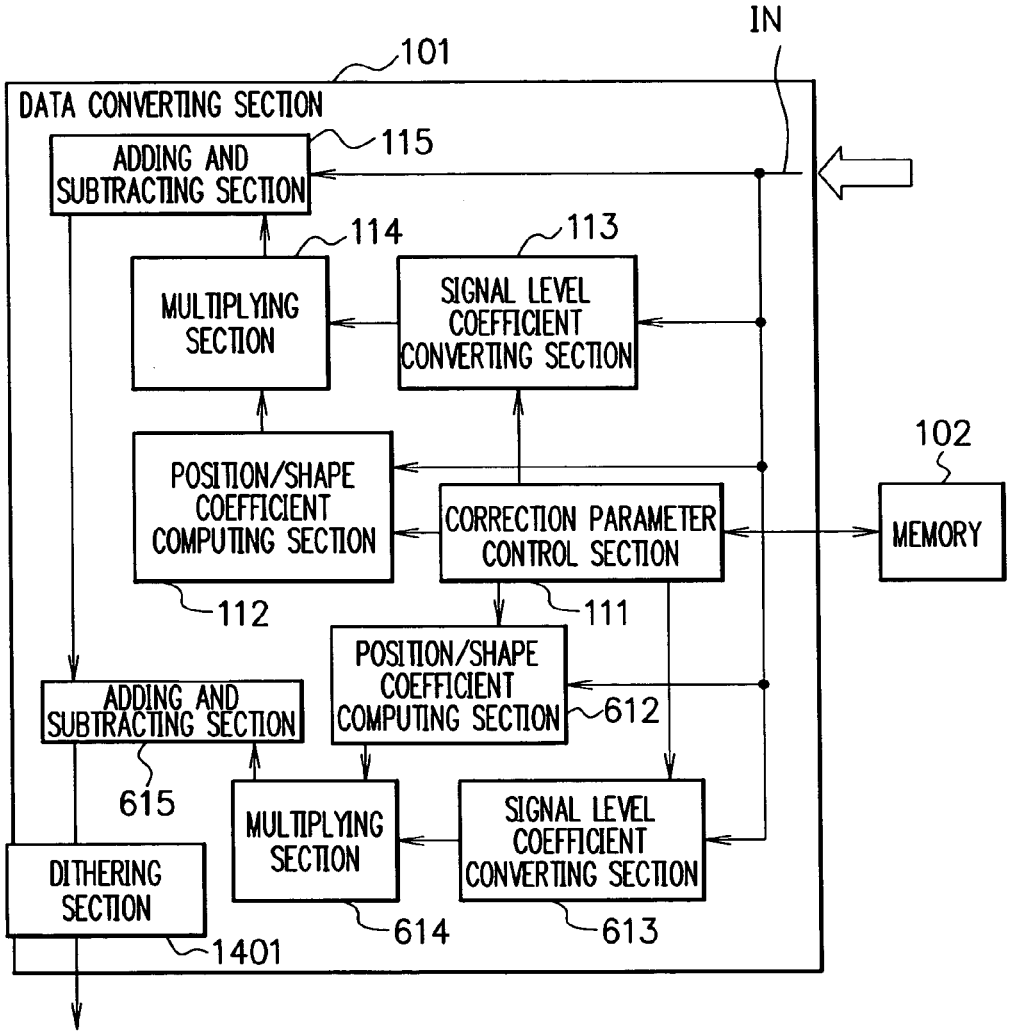
FIG. 14 is a block diagram showing a configuration example of a data converting section according to the seventh embodiment of the present invention.

FIG. 14 is a block diagram showing a configuration example of the data converting section 101 according to the present embodiment. The present embodiment is different from FIG. 6 in that a dithering section 1401 is added. The dithering section 1401 inputs a correction image signal outputted from the adding and subtracting section 615, performs the dithering process, and outputs to the control section 103 the correction image signal that is dithered. The dithering section 1401 performs the dithering process with respect to the decimal tone value and so forth, using the mask patterns 1131 to 1314.

Figure 15:
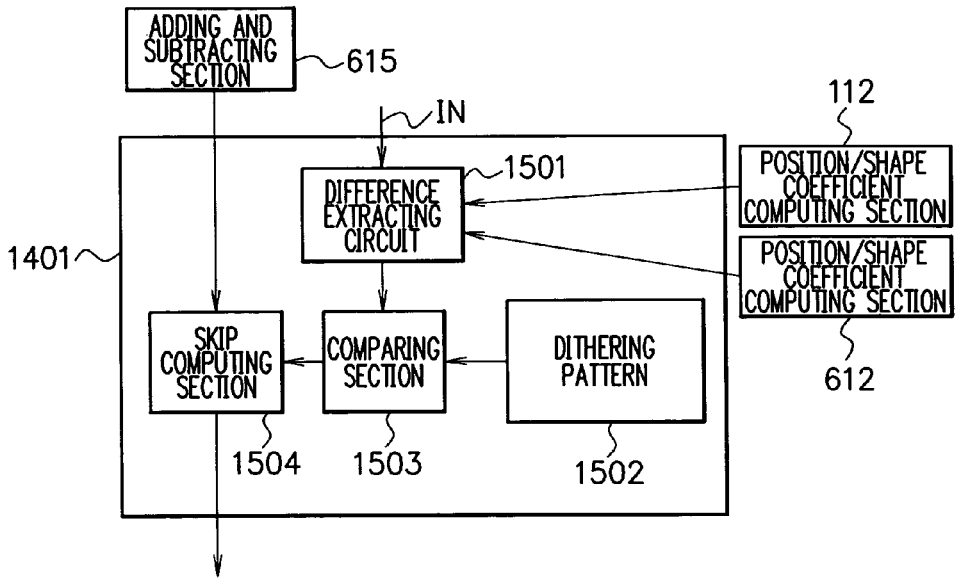
FIG. 15 is a block diagram showing a configuration example of a dithering section.

FIG. 15 is a block diagram showing a configuration example of the dithering section 1401. A difference extracting circuit 1501 inputs an input image signal IN, a correction coefficient by the position shape coefficient computing section 112, and a correction coefficient by the position shape coefficient computing section 612, and computes the difference data 1303 of the region 1302 located in the input image signal IN in FIG. 13. The region 1302 in the irregular display 1301 can be extracted based on the correction coefficients by position shape coefficient computing sections 112 and 612.

A dithering pattern storing section 1502 stores, for example, dithering mask patterns 1311 to 1314 used in correcting the irregular display in FIG. 13, for example. The comparing section 1503 compares the difference data 1303 with the dithering mask patterns 1311 to 1314, and directs a skip computing section 1504 to skip (eliminate) the coinciding mask pattern 1313. The skip computing pattern 1504 skips the coinciding mask pattern 1313, and uses the non-coinciding patterns 1311, 1312, and 1314 to dither an output signal from the adding and subtracting section 615.

As described above, a part of the irregular display correction portion in the input image signal IN is extracted, in which the difference data 1303 based on a minimum data is calculated. When the difference data 1303 coincides with any of the dithering mask patterns 1311 to 1314 used to correct the irregular display, the coinciding dithering mask pattern is skipped. This can prevent interference caused by overlapping of the input image signal IN dithering pattern and the irregular display correction dithering pattern. Alternatively, a dithering pattern of a separate method not using the coinciding dithering pattern 1313 can be generated.

Eighth Embodiment

An eighth embodiment of the present invention has a basic configuration identical to the first embodiment (FIG. 1).

Figure 16:
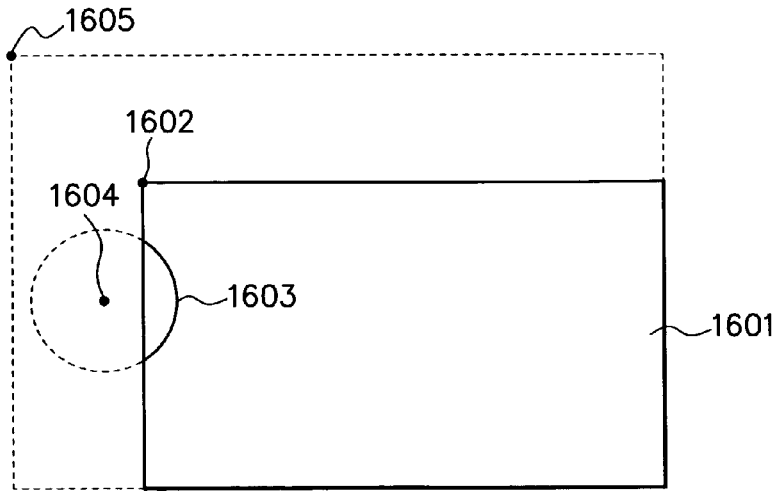
FIG. 16 is an explanatory diagram of coordinates showing a pixel position.

FIG. 16 is an explanatory diagram of coordinates indicating pixel position. A display region 1601 of the display panel 106 has a top left point 1602 being an origin with the x and y coordinates of 0 (zero). However, when the top left point 1602 is taken as the origin, there exists a case in which a center point 1604 of an irregular display region 1603 is located outside the display region 1601. The center point 1604 thus has coordinates of negative values. Calculation of negative-value coordinates increases the number of bits of positive/negative codes and causes a disadvantage in the circuit. Accordingly, the coordinate system of an origin 1605 is determined such that the irregular display region center point 1604 outside the display region 1601 does not take a negative value. The position shape coefficient computing section 112 generates a correction coefficient Ka using a pixel coordinate system which is different from the pixel coordinate system of the display panel 106.

As described above, when the center point 1604 in the region 1603 subject to correction of the irregular display is located outside the display region 1601, the coordinate data which is to be calculated in the position shape coefficient computing section 112 takes negative values. This results in a circuit branching in this portion and an increase in signal width towards the adder. To avoid this, the coordinates of the top left point 1602 in the display region 1601 is set as (a, b), so that the irregular display region center point 1604 outside the display region does not take negative values. Establishing the origin 1605 allows "a" and "b" to take positive integer of one or greater.

Ninth Embodiment

Figure 17:
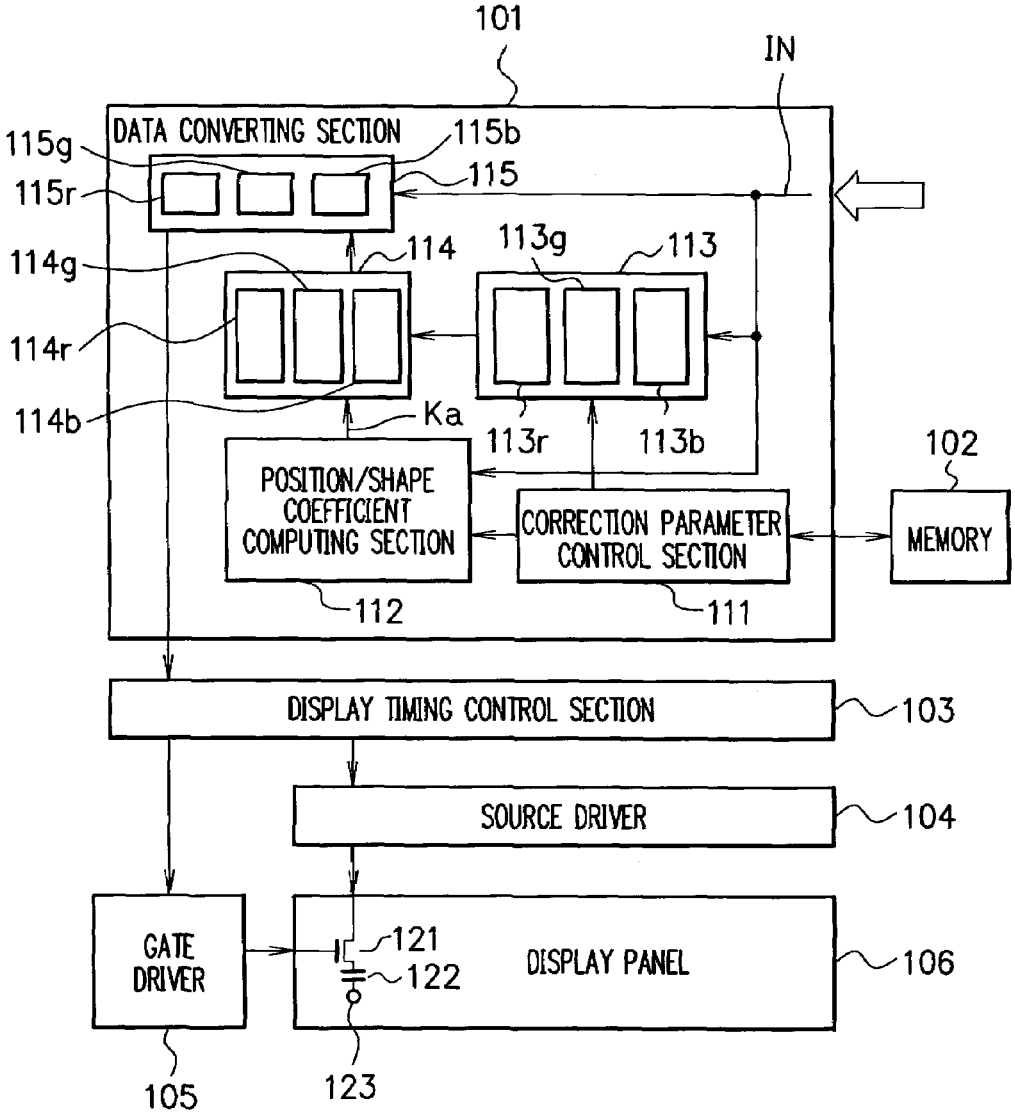
FIG. 17 is a block diagram showing a configuration example of a liquid crystal display according to a ninth embodiment of the present invention.

FIG. 17 is a block diagram showing a configuration example of a crystal liquid display according to a ninth embodiment of the present invention. Explained here are points of difference of the ninth embodiment from the first embodiment (FIG. 1). As input image signals IN, input image signals of red (R), green (G), and blue (B) respectively are inputted in parallel. The signal level coefficient converting section 113 has therein a converting part 113*r* to generate a red correction value, a converting part 113*g* to generate a green correction value, and a converting part 113*b* to generate a blue correction value, so that it can generate different correction values according to the color. The multiplying section 114 has therein a multiplier 114*r* to multiply the red correction value by the correction coefficient Ka, a multiplier 114*g* to multiply the green correction value by the correction coefficient Ka, and a multiplier 114*b* to multiply the blue correction value by the correction coefficient Ka, and performs multiplication for each color. The adding and subtracting section 115 has therein an adder and subtractor 115*r* to add or subtract the red multiplied value to or from the red input image signal IN, an adder and subtractor 115*g* to add or subtract the green multiplied value to or from the green input image signal IN, and an adder and subtractor 115*b* to add or subtract the blue multiplied value to or from the blue input image signal IN, and performs addition or subtraction for each color.

When the signal level coefficient converting section 113 is constituted by a LUT, the LUT stores each different correction value for red, green and blue in a separate manner, so that the irregular display can be corrected for each color.

Tenth Embodiment

Figure 18:
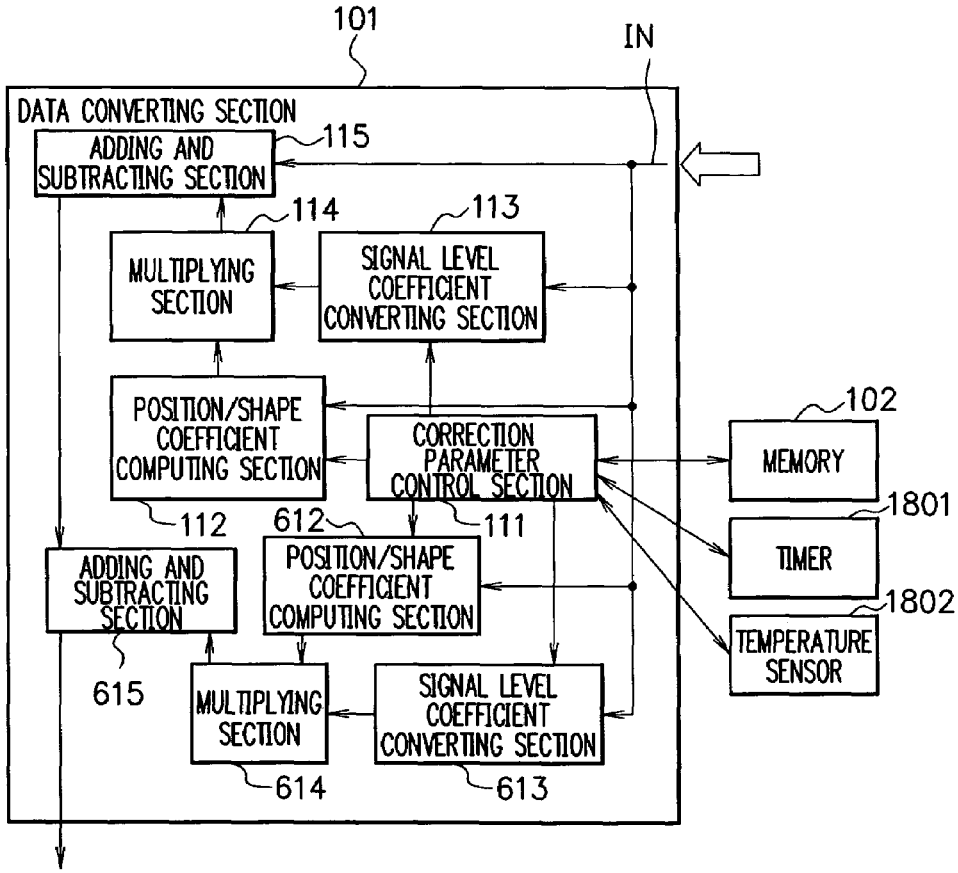
FIG. 18 is a block diagram showing a configuration example of a liquid crystal display according to a tenth embodiment of the present invention.

FIG. 18 is a block diagram showing a configuration example of a liquid crystal display according to a tenth embodiment of the present invention. Explained here are points of differences of the tenth embodiment from the third embodiment (FIG. 6). A timer 1801 and a temperature sensor 1802 are connected to the correction parameter control section 111. The timer 1801 outputs time data of the liquid crystal display. The temperature sensor 1802 detects and outputs the temperature of the liquid crystal display. The data converging sector 101 can correct irregular display according to the time data and/or temperature. The irregular display transforms with passing of time and depending on temperature. Correcting the irregular display based on the time data and temperature allows an appropriate correction. The data converting section 101 performs controlling in such a manner that a multiplied value by the multiplying section 144 is amended according to the value(s) from the timer 1801 and/or temperature sensor 1802. More specifically, based on the timer data and/or temperature data, the correction parameter control sector 111 corrects the correction level to be outputted to the signal level coefficient converting section 113, and the signal level coefficient converting section 113 corrects the correct value, or the position shape coefficient computing section 112 corrects the correct coefficient Ka.

Other methods can also be applied. For example, the correction coefficient is computed according to the timer data and/or temperature data. The correction coefficient is multiplied by the multiplied values of the multiplying sections 114 and 614 respectively, and the results are respectively added or subtracted in the adding and subtracting sections 115 and 615.

Eleventh Embodiment

Figure 19:
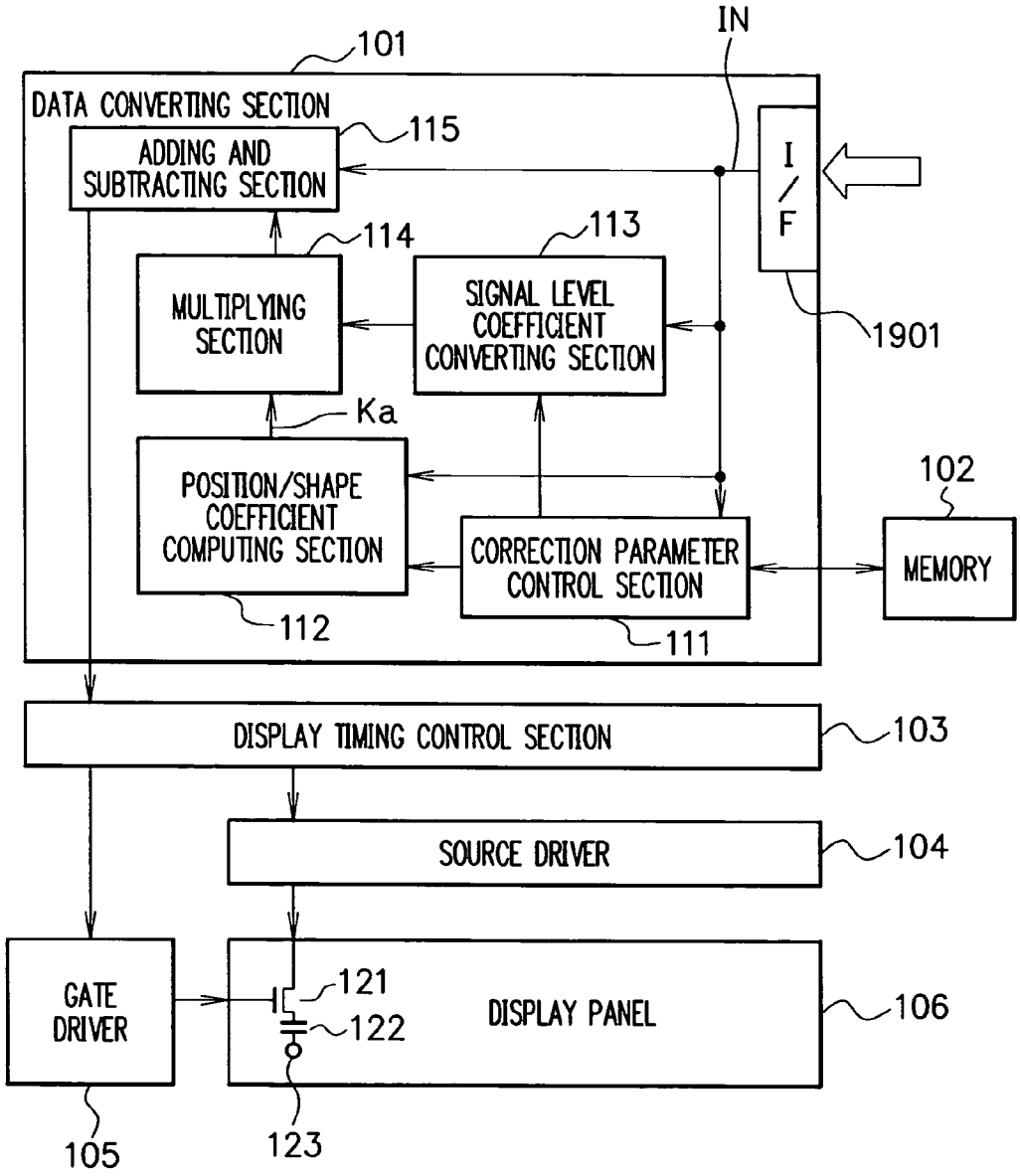
FIG. 19 is a block diagram showing a liquid crystal display according to an eleventh embodiment of the present invention.

FIG. 19 is a block diagram showing a configuration example of a liquid crystal display according to an eleventh embodiment of the present invention. Explained here are points of difference of the eleventh embodiment from the first embodiment (FIG. 1). An input image signal IN is externally inputted through an interface 1901. In the present embodiment, a method to write a correction parameter in the memory 102 will be explained. A correction parameter is inputted externally through an input terminal identical to the input terminal through which the input image signal IN is inputted. Here, a write mode signal of the correction parameter is inputted through the interface 1901. Consequently, the correction parameter write mode is set, and the irregular display correction mode is released. The correction parameter control section 111 inputs the correction parameter externally, and writes it in the memory 102. Sharing the input terminal for the input image signal IN and the input terminal for the correction parameter allows reduction of the number of the input terminals, the size of ASIC101, and costs.

As has been described, according to the first to eleventh embodiments, the signal processing is performed to the irregular display of the display panel caused through the fabrication process and so forth, such that the irregular display can be easily alleviated. Consequently, the yield of the display panels can be improved, and the costs can be reduced.

The present embodiment is to be considered in all respects as illustrative and no restrictive, and all changes which come within the meaning and range of equivalency of the claims are therefore intended to be embraced therein. The invention may be embodied in other specific forms without departing from the spirit or essential characteristics thereof.

What is claimed is:

1. An image signal processing device, comprising:

a memory to store a first correction parameter to convert a specific region of display image of a display panel, said first correction parameter comprised of a shape data and correction level;

a first coefficient generating section to generate a first coefficient for each pixel in the display panel based on the first correction parameter;

a first correction value generating section to generate a first correction value for each pixel based on an input image signal;

a first multiplier to multiply the first coefficient by the first correction value for each pixel and output a first multiplied value; and a first adder to add or subtract the first multiplied value to or from the input image signal for each pixel.

2. The image signal processing device according to claim 1, wherein said memory stores a first and a second correction parameters to correct in a first and a second regions, and wherein said first correction value generating section generates separate correction values for each of the first and the second regions based on the first and the second correction parameters.

3. The image signal processing device according to claim 1, wherein said memory stores a first and a second correction parameters to correct, and further comprising:

a second coefficient generating section to generate a second coefficient for each pixel in the display panel based on the second parameter;

a second coefficient value generating section to generate a second correction value for each pixel based on an input image signal;

a second multiplier to multiply the second coefficient by the second correction value for each pixel and output a second multiplied value; and a second adder to add or subtract the second multiplied value to or from the output value from said first adder for each pixel.

4. The image signal processing device according to claim 1, wherein said memory stores a first correction parameter containing shape data and shape conversion data of a correction, and wherein said first coefficient generating section generates a first coefficient based on a shape rotated or distorted based on the shape data and the shape conversion data.

5. The image signal processing device according to claim 1, wherein said first coefficient generating section generates the first coefficient such that it performs computation by reducing the number of bits indicating a pixel position, and thereafter compensates the pixel position of the reduced number of bits.

6. The image signal processing device according to claim 1, wherein said first coefficient generating section generates the first coefficient such that a region to be corrected is shifted at each predetermined time.

7. The image signal processing device according to claim 1, further comprising a dithering section to generate a mask pattern of dithering for correcting according to the input image signal.

8. The image signal processing device according to claim 1, wherein said first coefficient generating section generates a first coefficient using a pixel coordinate system different from a pixel coordinate system of the display panel.

9. The image signal processing device according to claim 8, wherein said first coefficient generating section generates the first coefficient using a pixel coordinate system which represents a pixel coordinate origin of the display panel by a positive integer of one or greater.

10. The image signal processing device according to claim 1, wherein said first adder computes an input image signal containing red, green and blue in terms of each color.

11. The image signal processing device according to claim 10, wherein said first correct value generating section and said first multiplier process data in terms of each color.

12. The image signal processing device according to claim 1, further comprising a timer and/or a temperature sensor, and wherein controlling is performed such that the first multiplied value is corrected based on values (a value) of said timer and/or said temperature sensor.

13. The image signal processing device according to claim 1, further comprising a memory control section to input the first correction parameter externally to said memory through a terminal which is identical to an input terminal through which the input image signal is inputted.

14. The image signal processing device according to claim 1, further comprising a liquid crystal display panel to perform displaying based on an output value from said first adder.

15. An image signal processing method, comprising the steps of:

generating a first coefficient for each pixel in a display panel based on a first correction parameter for converting a specific region of display image of a display panel in a memory;

generating a first correction value for each pixel based on an input image signal, said first correction parameter comprised of a shape data and correction level;

multiplying the first coefficient by the first correction value for each pixel and outputting a first multiplied value; and adding or subtracting the first multiplied value to or from the input image signal for each pixel.

16. A liquid crystal display device, comprising:

a liquid crystal display panel;

a memory to store a first correction parameter to convert a specific region of display image of said liquid crystal display panel, said first correction parameter comprised of a shape data and correction level;

a first coefficient generating section to generate a first coefficient for each pixel in said liquid crystal display panel based on the first correction parameter;

a first correction value generating section to generate a first correction value for each pixel based on an input image signal;

a first multiplier to multiply the first coefficient by the first correction value for each pixel and output a first multiplied value; and a first adder to add or subtract the first multiplied value to or from the input image signal for each pixel.

* * * * *